US011578494B2

(12) United States Patent
Whitridge, Jr. et al.

(10) Patent No.: US 11,578,494 B2
(45) Date of Patent: Feb. 14, 2023

(54) ROOFING SYSTEM AND METHOD

(71) Applicant: Millennium Slate, LLC, Middle Granville, NY (US)

(72) Inventors: Frederick W. Whitridge, Jr., Stanfordville, NY (US); Philip C. Prehoda, Middle Granville, NY (US); Thomas J. Collard, West Pawlet, VT (US)

(73) Assignee: Millennium Slate, LLC, Middle Granville, NY (US)

( * ) Notice: Subject to any disclaimer, the term of this patent is extended or adjusted under 35 U.S.C. 154(b) by 251 days.

(21) Appl. No.: 16/694,436

(22) Filed: Nov. 25, 2019

(65) Prior Publication Data

US 2020/0141122 A1 May 7, 2020

Related U.S. Application Data

(63) Continuation-in-part of application No. 16/000,347, filed on Jun. 5, 2018, now Pat. No. 10,829,937.
(Continued)

(51) Int. Cl.
*E04D 1/34* (2006.01)
*E04D 1/00* (2006.01)

(52) U.S. Cl.
CPC ..... *E04D 1/34* (2013.01); *E04D 1/29* (2019.08); *E04D 2001/3429* (2013.01);
(Continued)

(58) Field of Classification Search
CPC .... E04D 2001/3429; E04D 2001/3447; E04D 2001/3455; E04D 2001/3438;
(Continued)

(56) References Cited

U.S. PATENT DOCUMENTS 623,988 A 5/1899 Contant
676,579 A 6/1901 Esselen
(Continued)

FOREIGN PATENT DOCUMENTS

DE 4100902 A1 8/1991
DE 29819035 U1 2/1999
(Continued)

*Primary Examiner* — Brian D Mattei
*Assistant Examiner* — Charissa Ahmad
(74) *Attorney, Agent, or Firm* — Bulkley, Richardson and Gelinas, LLP; Mary R. Bonzagni, Esq.

(57) ABSTRACT

A lighter, more cost-effective roofing system and method, which includes a rain diverting feature for directing rainwater and snowmelt away from an underlying sheet material and roof deck, is provided. The invention includes a sheet material having an upper surface and a lower surface. The upper surface includes one of a hook and loop fastener and the lower surface is configured to be attached to the roof deck. The present invention further includes a plurality of roofing tiles, each tile having hook and loop fasteners adhered to a back face which extend along the width of the tile at or near the uppermost and lowermost edges. Each rain diverting feature, which is a strip-like device with one surface made up of a plurality of hook portions and an opposing surface made up of a plurality of portions complementary to the hook portions, is positioned between and releasably attached to the hook and loop fasteners located on a side-edge portion of two adjacent tiles and the underlying sheet material, thereby releasably attaching the tiles to each other and to the upper surface of the underlying sheet material. The use of rain diverting devices to direct rainwater and snowmelt away from the underlying sheet material and roof deck allows for single lap tiling and thus less weight on the roof deck. It also allows for shorter tiles to be used, thus saving material cost.

24 Claims, 9 Drawing Sheets

Related U.S. Application Data

(60) Provisional application No. 62/515,162, filed on Jun. 5, 2017.

(52) U.S. Cl.
CPC ..... *E04D 2001/3447* (2013.01); *E04D 2001/3458* (2013.01); *E04D 2001/3473* (2013.01)

(58) Field of Classification Search
CPC .... E04D 2001/3485; E04D 2001/3414; E04D 2001/3458; E04D 2001/3473; E04D 1/34; E04D 1/29; E04D 1/365
See application file for complete search history.

(56) References Cited

U.S. PATENT DOCUMENTS 1,107,568 A 8/1914 Bamberger et al.
1,462,212 A 7/1923 Percsenyi
1,467,510 A 9/1923 Smith, Jr.
1,590,744 A 6/1926 Hatch
1,597,135 A 8/1926 Wittenberg
1,619,600 A 3/1927 Cumfer
1,661,562 A 3/1928 Conway
RE17,143 E * 11/1928 Fischer ..... E04D 1/28 52/540
1,963,583 A 6/1934 Jenkins
2,419,818 A 3/1939 North
2,210,209 A 8/1940 Kirschbraun
2,250,918 A 7/1941 Roos
2,292,984 A 8/1942 Alvarez, Jr.
2,300,488 A 11/1942 Cuno
2,535,620 A 12/1950 Alvarez, Jr.
3,077,703 A * 2/1963 Bergstrom ..... E04D 3/355 52/592.4
3,391,434 A * 7/1968 Girard ..... E04F 13/0882 24/444
3,418,777 A 12/1968 Gillis
3,434,259 A * 3/1969 Corbin ..... E04D 1/29 52/420
3,574,019 A * 4/1971 Girard ..... A47G 27/045 156/84
3,703,062 A 11/1972 McKinney
3,913,294 A 10/1975 Freiborg
3,945,166 A 3/1976 Hosoda et al.
3,999,348 A 12/1976 Hicks
4,426,823 A 1/1984 Kobe
4,489,115 A 12/1984 Layman et al.
4,499,700 A 2/1985 Gustafsson
4,649,069 A 3/1987 Tone
4,668,315 A 5/1987 Brady et al.
4,744,189 A * 5/1988 Wilson ..... B44C 1/28 40/908
4,755,401 A * 7/1988 Friedrich ..... A63C 19/06 273/DIG. 13
4,974,384 A 12/1990 Pacione
5,060,443 A * 10/1991 Pacione ..... E04F 13/0882 52/483.1
5,144,786 A * 9/1992 Pacione ..... E04F 13/0882 52/511
5,239,802 A * 8/1993 Robinson ..... E04D 1/26 52/553
5,400,558 A * 3/1995 Hannah ..... E04D 1/20 52/518
5,457,924 A 10/1995 Fujii et al.
5,505,788 A 4/1996 Dinwoodie
5,617,690 A 4/1997 Gibbs
5,642,596 A 7/1997 Waddington
5,723,195 A * 3/1998 Pacione ..... A47G 27/0437 156/293
5,737,881 A 4/1998 Stocksieker
5,794,396 A 8/1998 Gibbs
5,916,103 A 6/1999 Roberts
5,950,319 A * 9/1999 Harris ..... E04F 21/04 33/494
5,950,387 A 9/1999 Stahl et al.
6,083,596 A * 7/2000 Pacione ..... A47G 27/045 156/304.3
6,148,578 A 11/2000 Nowacek et al.
6,298,624 B1 10/2001 Pacione
6,336,304 B1 1/2002 Mimura et al.
6,395,362 B1 * 5/2002 Pacione ..... B44C 1/28 428/45
6,516,572 B1 * 2/2003 Nowacek ..... E04D 1/20 52/90.1
6,534,703 B2 3/2003 Dinwoodie
7,045,197 B2 * 5/2006 Harris ..... E04F 21/04 33/1 B
7,219,476 B2 5/2007 Akins et al.
7,578,108 B2 8/2009 Swanson
8,099,923 B2 * 1/2012 Jolitz ..... E04D 1/12 52/518
8,256,185 B2 9/2012 Kirkey
8,276,329 B2 10/2012 Lenox
8,297,020 B1 10/2012 Swanson
9,234,352 B2 1/2016 Olson et al.
9,399,870 B2 * 7/2016 Leitch ..... B32B 11/12
9,788,674 B2 10/2017 Pacione et al.
9,926,704 B1 * 3/2018 Nowacek ..... E04F 13/0828
10,233,646 B2 3/2019 McGraw et al.
10,358,824 B2 7/2019 Aschenbeck et al.
D867,623 S * 11/2019 Grubka ..... B32B 5/024 D25/139
2001/0042350 A1 11/2001 Pacione
2002/0136846 A1 * 9/2002 Prevost ..... E01C 13/08 428/17
2003/0070391 A1 4/2003 Tachauer et al.
2004/0000334 A1 1/2004 Ressler
2004/0055240 A1 3/2004 Kiik et al.
2004/0187420 A1 * 9/2004 Bernardi ..... E04D 5/146 52/410
2005/0252141 A1 11/2005 Kerkar et al.
2005/0281963 A1 * 12/2005 Cook ..... E01C 13/08 428/17
2006/0039754 A1 * 2/2006 Linville ..... E01C 13/08 404/73
2006/0154017 A1 7/2006 Shepard et al.
2006/0191218 A1 8/2006 Pacione
2007/0227090 A1 * 10/2007 Plante ..... E04B 1/68 52/506.01
2007/0266660 A1 11/2007 Davies et al.
2007/0272320 A1 * 11/2007 Roberson ..... F16L 59/08 138/167
2008/0245399 A1 * 10/2008 DeLiddo ..... F24S 25/16 136/244
2009/0049765 A1 * 2/2009 Grant ..... E04B 1/66 52/105
2009/0064618 A1 * 3/2009 Ben-Daat ..... B32B 5/024 52/408
2009/0159118 A1 6/2009 Kalkanoglu et al.
2009/0220720 A1 9/2009 Mohseen et al.
2009/0255201 A1 10/2009 Kraus et al.
2009/0266400 A1 * 10/2009 DeLiddo ..... H02S 20/23 136/244
2010/0059104 A1 3/2010 Geary
2010/0236165 A1 * 9/2010 Smith ..... F24S 25/61 52/173.3
2012/0266559 A1 10/2012 Thies, III
2013/0000237 A1 1/2013 Kraus et al.
2013/0001820 A1 1/2013 Kraus et al.
2013/0008113 A1 1/2013 Kraus et al.
2013/0025225 A1 1/2013 Vermillion et al.
2013/0067852 A1 3/2013 Kalkanoglu et al.
2013/0160388 A1 6/2013 Williams et al.
2015/0089895 A1 4/2015 Leitch
2015/0275520 A1 * 10/2015 Nawate ..... E04D 13/0481 52/302.1
2016/0340903 A1 11/2016 Folkersen et al.

(56) References Cited

U.S. PATENT DOCUMENTS

| | | | |
|---|---|---|---|
| 2017/0145271 | A1 | 5/2017 | Loftus et al. |
| 2017/0306632 | A1 | 10/2017 | Wood et al. |
| 2018/0347195 | A1 | 12/2018 | Whitridge, Jr. et al. |

FOREIGN PATENT DOCUMENTS

| | | | | | |
|---|---|---|---|---|---|
| DE | 19926344 | C1 | | 3/2001 | |
| DE | 102013006616 | A1 | * | 10/2014 | |
| EP | 1795654 | | | 6/2007 | |
| EP | 2508688 | A2 | * | 10/2012 | |
| EP | 2669446 | | | 12/2013 | |
| EP | 3002383 | A1 | * | 4/2016 | ..... E04D 5/143 |
| FR | 2483493 | A | | 12/1981 | |
| GB | 2145131 | A | | 3/1985 | |
| GB | 2341618 | A | | 3/2000 | |
| JP | 2003090103 | A | * | 3/2003 | ..... E04D 1/365 |
| JP | 2004019398 | A | * | 1/2004 | ..... E04D 1/365 |
| KR | 1944212 | B1 | | 1/2019 | |
| NL | 2006964 | | | 12/2012 | |
| WO | WO 8102437 | | | 9/1981 | |
| WO | WO 9836139 | | | 8/1998 | |
| WO | WO-2008063660 | A2 | * | 5/2008 | ..... E04D 11/00 |
| WO | WO-2010034730 | A2 | * | 4/2010 | ..... H02S 20/00 |

* cited by examiner

ROOFING SYSTEM AND METHOD

CROSS-REFERENCE TO RELATED APPLICATIONS

This application is a continuation-in-part application of U.S. patent application Ser. No. 16/000,347 filed Jun. 5, 2018, which claims the benefit of priority of U.S. Provisional Patent Application Ser. No. 62/515,162, filed Jun. 5, 2017, the contents of each application herein incorporated by reference.

BACKGROUND OF THE INVENTION

The present invention relates to roofing and more particularly to a lighter, more cost-effective roofing system and method of roofing, which utilizes a rain diverting feature for directing rainwater and snowmelt away from an underlying sheet material and/or roof deck.

As is well known to those skilled in the art, types of roofing tiles include, but are not limited to, asphalt, wood, cement, fiber-cement mixtures, concrete, clay or ceramic material, natural stone such as slate, slate substitutes, rubber slate, other hardwearing materials and metal.

Existing systems for affixing, for example, slate roofing tiles to buildings are expensive in terms of both materials and labor. The current systems include nailing or screwing slate to the roof, using cumbersome hook and rail systems, or using a clamping type track system. Each of these traditional systems are expensive in terms of material and require a considerable amount of labor.

Additionally, nailed and screwed applications can be "over nailed" or "under nailed" referring to the height of the head of the fastener in relation to the face of the slate. Under nailed slate, with heads that protrude above the face of the slate, may break the pieces of slate which overlap them. Over nailed slate, with a head of the nail driven down into the countersink area on the slate, risks breakage. Hook and rail systems can be troublesome if the nailing eye of the hook is missed. Hooks can typically only be applied in a rigidly preset pattern and do not adapt easily to varying field conditions or design changes which may become desirable during installations. Tracked and clamping systems are also very rigid in terms of layout and don't allow variations in the natural material.

Further, the art teaches the arrangement of such natural stone roofing tiles in either a double or triple overlap to reduce or avoid rainwater and snowmelt entering into the separation between adjacent tiles and onto an underlying substrate. As used herein, the term "double overlap" means that the upper tile extends over the tiles two courses or rows down on the roof deck, while the term "triple overlap" means that the upper tile extends over the tiles three rows down.

As will be readily appreciated, double and triple overlap of natural stone roofing tiles increases the deadload on a roof or supporting structure. It also requires the use of tiles of a certain minimum length, which increases material costs.

As can be seen, there is a need for an improved system and method of roofing, which addresses the above-noted drawbacks.

SUMMARY OF THE INVENTION

The present invention overcomes these drawbacks by providing a lighter, more cost-effective roofing system, which includes a rain diverting feature for directing rainwater and snowmelt away from an underlying sheet material and roof deck. In an exemplary embodiment, the system of roofing comprises:

a sheet material for adhering to a roof deck, which has an upper surface and a lower surface, the upper surface including a hook and loop fastener;

a plurality of roofing tiles each having a back face with opposing side-edge portions;

hook and loop fasteners adhered to and covering a portion of the back face of each tile including a portion of the opposing side-edge portions;

a plurality of rain diverting devices, each device having one surface made up of a plurality of hook portions and an opposing surface made up of a plurality of portions complementary to the hook portions, wherein each rain diverting device is positioned between and releasably attached to the hook and loop fasteners located on a side-edge portion of two adjacent tiles and the sheet material, thereby releasably attaching the tiles to each other and to the upper surface of the underlying sheet material.

The term "side-edge portions" means those portions of the back face of each tile which extend from a line parallel to and on either side of a tile's lengthwise midline to a side-edge, each side-edge portion occupying less than 50 percent (%), preferably from about 15 to about 35%, of the total surface area of the back face of each tile.

An advantage of this embodiment is that the hook and loop fastener on the roofing tiles that is covered by the rain diverting device is covered by another layer of hook and loop fastener, so that the strength of the bond between each tile and the underlying sheet material is not reduced.

The term "tile" or "roofing tile" as used in the present specification refers to slabs or shingles made from asphalt (i.e., fiberglass sandwiched between asphalt and ceramic granules), wood, cement, fiber-cement mixtures, concrete, clay or ceramic material, natural stone such as slate, slate substitutes, rubber slate, and other hardwearing materials and metal (e.g., steel, aluminum, copper, alloy strips) including stone-coated steel.

In another aspect of the present invention, a method of installing tiles on a roof is provided, which comprises:

providing a sheet material having an upper surface and a lower surface, the upper surface including a hook and loop fastener;

securing the lower surface of the sheet material to a roof deck;

providing a plurality of roofing tiles, each tile having a back face with opposing side-edge portions, wherein hook and loop fasteners are adhered to and cover a portion of the back face of each tile including a portion of the opposing side-edge portions;

providing a plurality of rain diverting devices, each device having one surface made up of a plurality of hook portions and an opposing surface made up of a plurality of portions complementary to the hook portions, positioning each rain diverting device between and releasably adhering each device to the hook and loop fasteners located on a side-edge portion of two adjacent tiles and the underlying sheet material, thereby releasably attaching the tiles to each other and to the upper surface of the sheet material.

The present invention further provides a method of using a device having one surface made up of a plurality of hook portions and an opposing surface made up of a plurality of portions complementary to the hook portions to direct rainwater and snowmelt away from an underlying sheet material on a roof deck, which comprises: positioning the device between and releasably adhering the device to hook and loop fasteners located on a side-edge portion of two adjacent roofing tiles and an underlying sheet material, thereby releasably attaching the tiles to each other and to the upper surface of the sheet material.

These and other features, aspects and advantages of the present invention will become better understood with reference to the following drawings, description and claims.

DETAILED DESCRIPTION OF THE INVENTION

Figure 1:
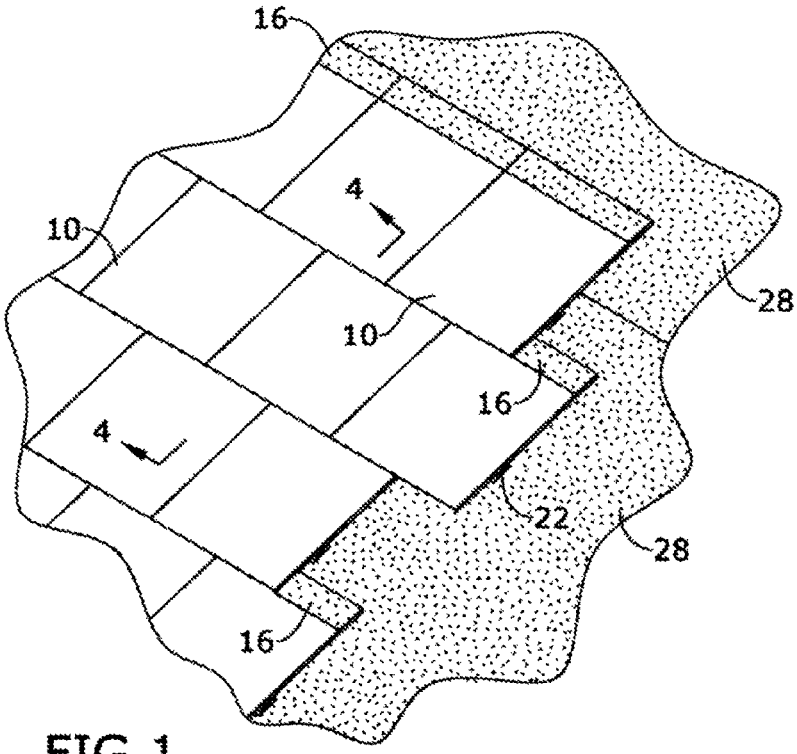
FIG. 1 is a perspective view of a partial installation of an embodiment of the present invention.
Figure 2:
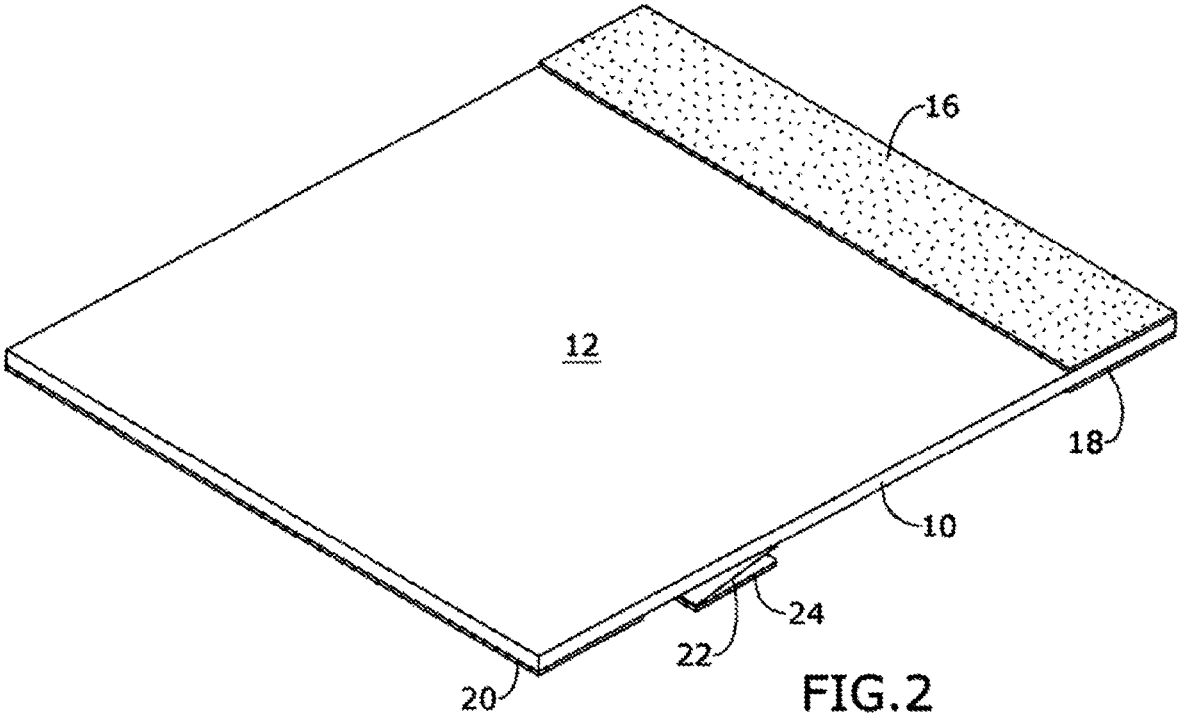
FIG. 2 is a top perspective view of a tile of an embodiment of the present invention.
Figure 3:
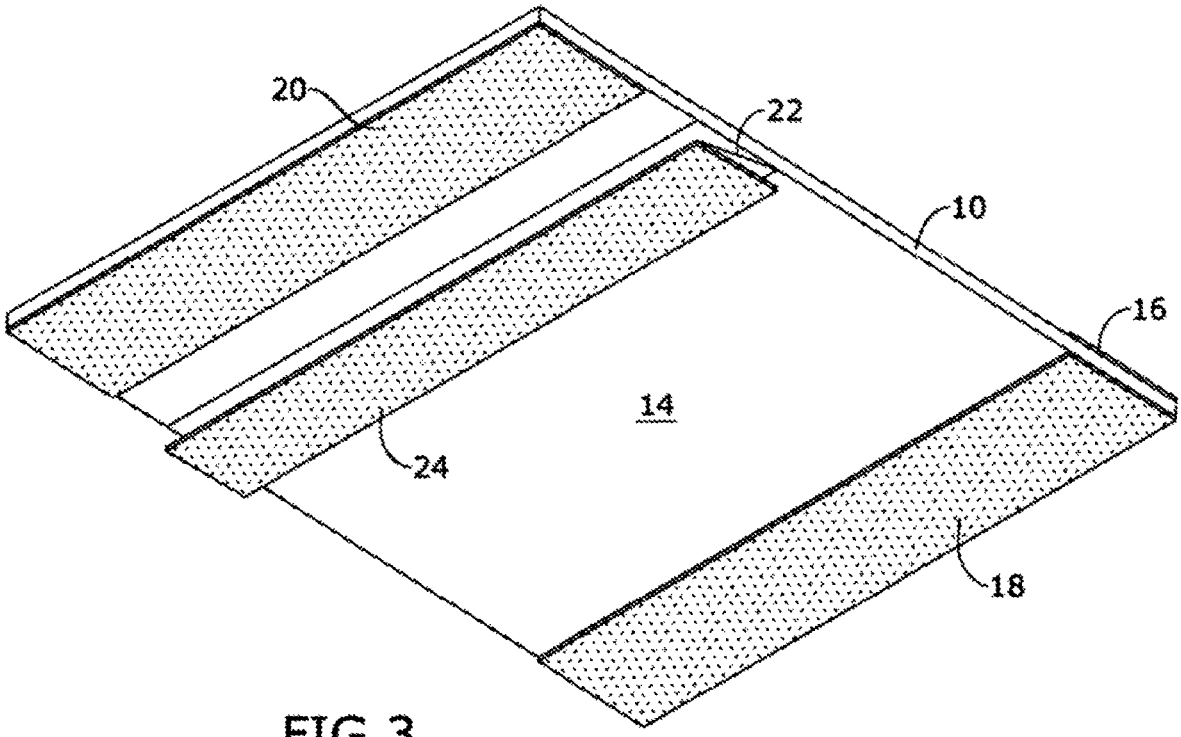
FIG. 3 is a bottom perspective view of a tile of an embodiment of the present invention.
Figure 4:
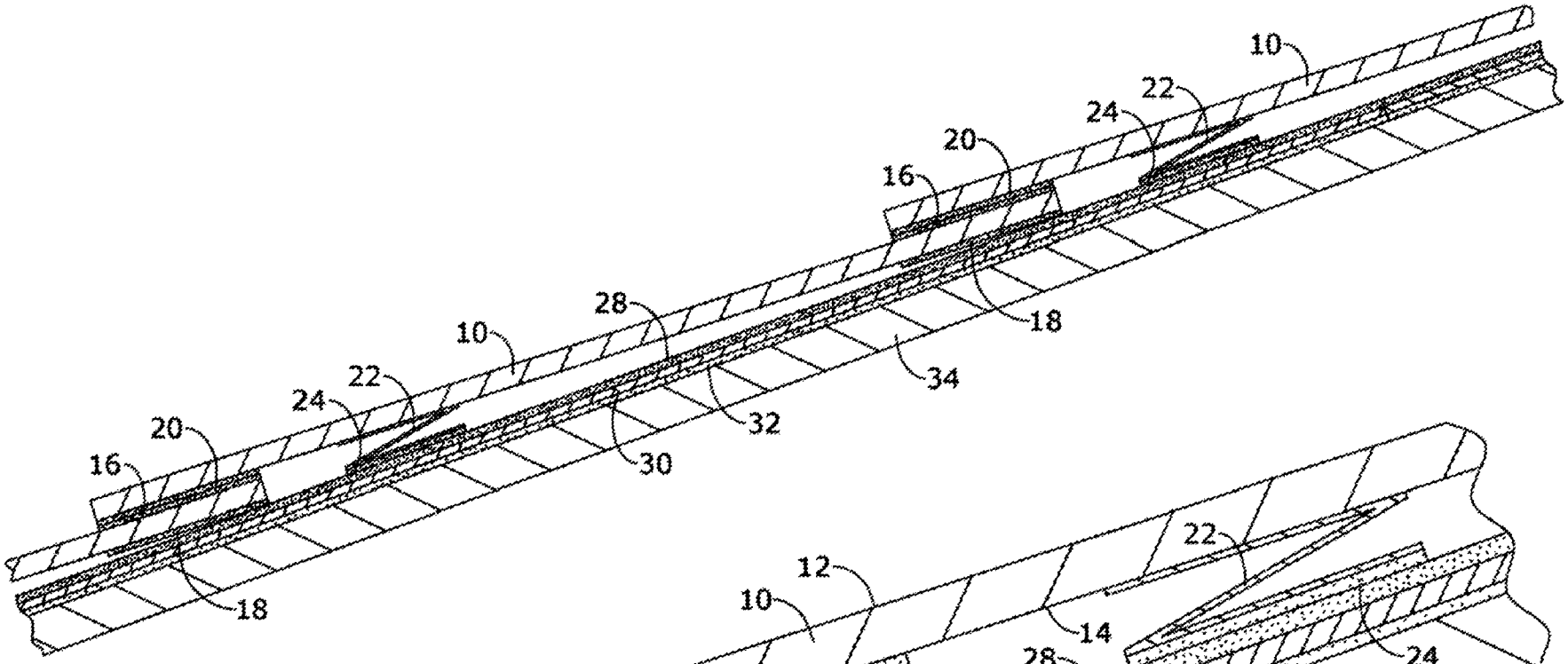
FIG. 4 is a section view of the present invention taken along line 4-4 in FIG. 1.
Figure 5:
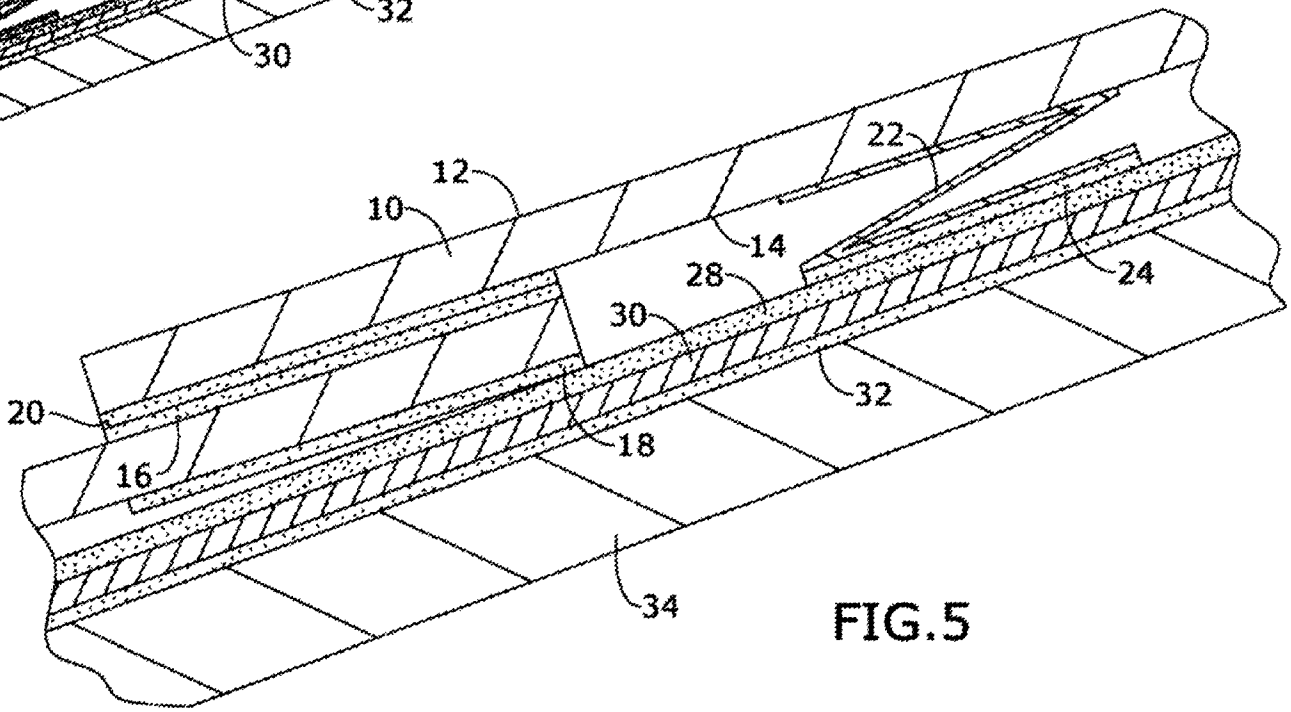
FIG. 5 is a detail section view of an embodiment of the present invention.
Figure 6:
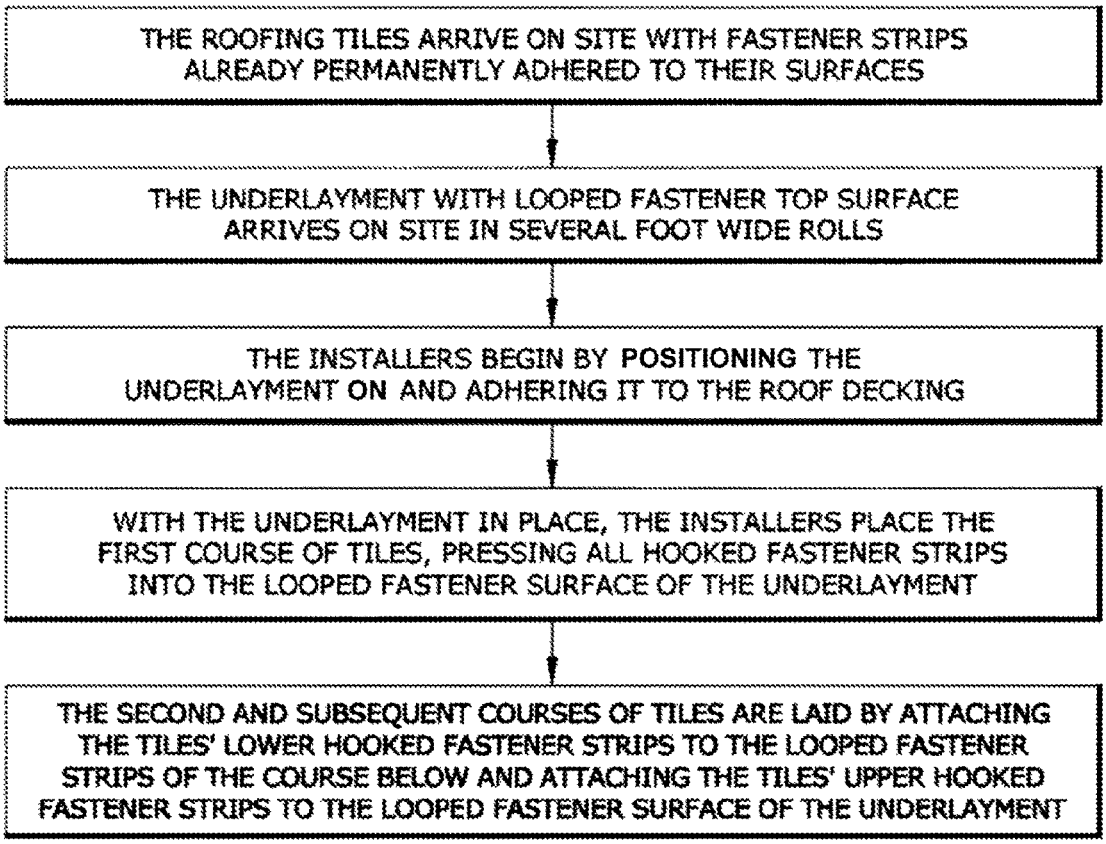
FIG. 6 is a flow chart of a method of installing tiles of an embodiment of the present invention.
Figure 7:
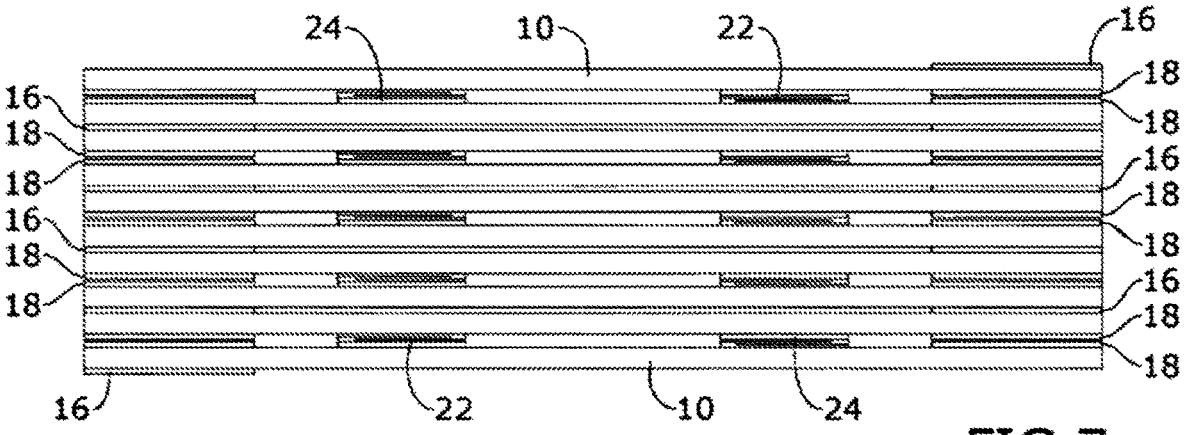
FIG. 7 is a side view of tiles in accordance with the present invention stacked for storage and shipping.

The following detailed description is of exemplary embodiments of the invention. The description is not to be taken in a limiting sense but is made merely for the purpose of illustrating the general principles of the invention, since the scope of the invention is best defined by the appended claims.

The present invention includes a system and method of roofing. A sheet material is positioned on and adhered to a bare roof or roof deck. This sheet material, which has an upper surface that includes a hook and loop fastener, is both a moisture barrier and serves as one half of the mechanical fastening hook and loop system. Hook and loop fasteners (e.g., in the form of tapes or patches) are adhered to a back face of individual roofing tiles. During or prior to installation, a strip-like, rain diverting device having a width is applied over and pressed down upon the hook and loop fasteners on each tile so that approximately one-half of the width of the device extends beyond the edge (a right side-edge portion) of the tile. Each tile with appended rain diverting device is then applied next to a previously installed tile and pressed onto both the exposed rain diverting device of that tile and the underlying sheet material on the roof deck (both with complimentary hook and loop fasteners). The tiles are applied in succession to complete each course or row on the roof deck, with each applied tile releasably attached to each adjacent tile.

Advantageously, the detachability of this hook and loop method allows changes to be easily made while installation is underway.

The hook and loop system and method of the present invention removes the variable quality and expensive field labor of traditional installation methods. Individual tiles may be easily pressed together in patterns which may be dictated by field conditions. Beneficially, changing an individual tile because of improper color or placement is easily solved by the detachable and replaceable nature of the hook and loop fastening system and the rain diverting devices.

As noted above, a further advantage of the above-described exemplary embodiment is that the hook and loop fastener on the roofing tiles that is covered by the rain diverting device is covered by another layer of hook and loop fastener, so that the strength of the bond between each tile and the underlying sheet material is not reduced. The subject invention allows for single instead of double or triple overlap, which allows for the use of shorter tiles, which saves material costs. It also reduces the overall weight of the entire roofing system, greatly reducing the demand on the supporting structure.

The term "hook and loop fastener" as used in the present specification refers to either portion of a fastener comprising two portions, namely a hook portion (e.g., J hook, palm tree hook, mushroom hook) and a portion complementary to the hook portion for example a loop portion such that the two portions are releasably interconnected when brought into contact with each other. Such fasteners are sold, for example, under the trade designations VELCRO and 3M DUAL-LOCK. The use of the term also includes those types of fasteners known as hook and hook fasteners in which there are opposing portions of interlockable hooks. The term also includes any other touch and grip type fastener of the type in which temporary interconnection is achieved when the two components thereof are brought into contact with each other.

In one exemplary embodiment, the hook and loop fastener is prepared from low surface energy resinous or plastic materials. In one such embodiment, the hook fasteners are polypropylene hook fasteners and the complimentary fasteners are nylon loop fasteners.

The hook and loop fastener has a preferred combined thickness of less than or equal to about 3 millimeters (mm), more preferably, from about 1 to about 3 mm, and most preferably, from about 1.5 to about 2.5 mm.

The degree of adhesion achieved by the hook and loop fastener is dependent upon such variables as the density of the hook and loop components, the height of the loops, the length of the hook stems and the weight of the roofing tile.

The hook and loop fasteners are adhered to and preferably cover less than about 35% of the back face of each tile. In a more preferred embodiment, the hook and loop fasteners are adhered to and cover from about 20 to about 35% of the back face and from about 10 to about 20% of the front face of each tile. The hook and loop fasteners may be applied in strip, band or patch forms, and are preferably applied in strip form, with each strip measuring greater than about 2.54 centimeters (cm) in width, preferably from about 3.8 to about 6.4 cm, and most preferably, about 5.1 cm. In one such preferred embodiment, at least two (2) strips (e.g., "loop" tape) are applied across substantially the entire width of a bottom edge and a top edge of the back face of the tile, while at least one (1) strip (e.g., "hook" tape) is applied across substantially the entire width of a top edge of the front face of the tile. This degree of coverage of the faces of the tile and the number, width and position of the applied strips allows higher peel strength (tiles don't pull up) and more shear strength (tiles don't slide out) than applications with fewer or narrower or differently positioned strips.

Suitable adhesives for adhering these hook and loop fasteners to roofing tiles such as slate or a slate substitute have been identified by the present inventors to include acrylic, epoxy, rubber-based and urethane adhesives, and the like. The adhesive can be used alone or in combination with other adhesives either as an admixture or in layers. The adhesive can have additives such as foaming agents, fillers, thickeners, or other additives commonly added to adhesives to change or enhance their physical properties.

The adhesive may be applied by brushing, rolling, spraying, or other means to distribute an even coat of adhesive to the target surface.

Prior to application of the adhesive, the hook and loop fastener may be subjected to a discharge treatment, or other surface treatment. The discharge treatment may be based on corona treatment or plasma treatment. The corona discharge or arc discharge is ejected by a gas stream and the plasma discharge is a plasma torch treatment in which the plasma discharge is ejected with a gas stream.

Opposing surfaces of the tiles may also be treated prior to the application of the adhesive.

The rain diverting device of the present invention, preferably in the form of a strip, has opposing surfaces, with one surface made up of a plurality of hook portions and an opposing surface made up of a plurality of portions complementary to the hook portions. As such, and in accordance with the inventive roofing system, the rain diverting device is releasably adherable to both the upper surface of the sheet material and to the hook and loop fastener on the back face of adjacent roofing tiles.

The inventive rain diverting device is applied to the hook and loop fastener located on the right and left side-edge portions of adjacent roofing tiles and serves the dual purpose of diverting rainwater and snowmelt away from the underlying substrate (i.e., sheet material) while securing the adjacent tiles to each other and to the underlying sheet material. The device diverts rainwater and snowmelt away from the underlying sheet material by preventing rainwater and snowmelt from going into the separation between adjacent roofing tiles and from flowing sideways underneath the tiles.

The rain diverting device may be formed from an elongated polymeric sheet material that is cut into finite length pieces. The thickness of the device is preferably less than or equal to about 3 millimeters (mm), more preferably from about 1 mm to about 3 mm, while the length of the device is preferably greater than or equal to the length of adjacent tiles, and more preferably ranges from about 100% to about 120% of the average length of the adjacent tiles. The width of the rain diverting device preferably ranges from about 5.1 centimeters (cm) to about 15.2 cm, more preferably from about 7.6 cm to about 10.2 cm.

In an exemplary embodiment, the color of the rain diverting device will match or blend with the color of the roofing tiles. In a preferred embodiment, the color of the rain diverting device is either gray or black.

Suitable rain diverting devices are available from: Fastech of Jacksonville, Inc., 960 Rogero Rd. #7 Jacksonville, Fla. 32211, under the trade designation DURAGRIP back to back hook and loop fastening tape; Speedtech International Inc., P. O. BOX 246, Racine, Wis. 53401, under the trade designation SPEEDWRAP back to back hook and loop fastening tape; and Halco Fasteners, Inc., 20269 Mack Street, Hayward, Calif. 94545, under the trade designation HALCO back 2 back hook and loop fastening tape.

The rain diverting device is preferably first adhered over the hook and loop fasteners on the back face of each tile. In one such embodiment, the rain diverting device with one surface made up of a plurality of hook portions is applied to extend along the length of the side-edge portion of each tile and over two or more strips of hook and loop fastener (e.g., "loop" tapes) that extend across the back face of the roofing tile at or near the top and bottom edges of the tile. The "hook" surface of the rain diverting device is applied over the "loop" tapes so that approximately one-half of the width of the device extends beyond the edge (the right side-edge portion) of the tile. Each tile with appended rain diverting device is then applied next to a previously installed tile and onto both the exposed rain diverting device of that tile and the underlying sheet material on the roof deck (both with complimentary hook and loop fasteners). The tiles are applied in succession to complete each course or row on the roof deck, with each applied tile releasably attached to each adjacent tile.

The rain diverting device may also be first applied to the sheet material on the roof deck, and then a tile may be placed on the rain diverting device on the roof. Due to the uneven nature of some roofing tiles, however, placing the rain diverting device on the roof first and then applying the tile over the device may form pockets along the edge of the tile where water could flow sideways. To avoid this from occurring, it is preferred to apply the rain diverting device to the back face of the tile first to ensure that no pockets are formed.

The sheet material for adhering to a roof deck is a continuous material having an upper surface and a lower surface. The upper surface includes a hook and loop fastener and the lower surface is configured to be attached to a roof deck. The sheet material is used to seal and protect the roof deck from the environment. Suitable sheet materials are available from Velcro USA, Inc., 95 Sundial Avenue, Manchester, N. H. 03103, under part number h847 (ultra-low profile hook sheet material).

An insulation board or cover-board may be positioned between the sheet material and the roof deck, protecting against wind uplift and pull-out and providing a cushion against impact and a durable substrate for adhesion. The insulation board may be composed of a closed-cell polyisocyanurate foam core bonded on opposing sides to fiber-reinforced paper facers.

The sheet material may be adhered to the insulation board using any suitable adhesive or adhesive composition.

Such a sheet material/insulation board assembly is available from Carlisle SynTec Incorporated, 1285 Ritner Highway, Carlisle, Pa. 17013 under the trade designation RAPIDLOCK roofing system.

Such assemblies may be mechanically fastened to a clean roof deck or may be secured using an adhesive or adhesive composition. For example, two-part polyurethane adhesives, which are made up of an isocyanate blend and a polyol blend that when mixed react or crosslink to form the polyurethane adhesive; may be used. The two parts may be mixed by an applicator just prior to being applied on the surface of the roof deck. The insulation board assembly would then be laid onto and adhered to the roof deck surface.

The bond between: (a) the sheet material and roof deck, or between the sheet material, an insulation board or coverboard and the roof deck; and (b) the hook and loop fasteners and each individual roofing tile, must each exhibit a bond strength that will withstand severe environmental conditions, including high winds and hail. The term "withstand", as used herein, means that the bond does not crack, break or collapse; thereby causing catastrophic failure of bonded structures in service. In particular, the resulting bond must be vibration-resistant, withstand high uplift forces; withstand temperatures ranging from about −40° to about 200° F., and demonstrate little or no "creep" at temperatures exceeding 200° F.

With the sheet material in place on the roof deck, the hook and loop fasteners adhered to at least the back faces of each tile, and the rain diverting device applied over the hook and loop fasteners on the back face (right side edge) of each tile, the tiles may be installed on the roof deck with a single lap (i.e., the upper tiles only extend over the tiles one layer down) with the tile overlap ranging from about 2.54 to about 8.9 cm, preferably from about 3.8 to about 7.6 cm, more preferably, from about 5.1 to about 6.4 cm. This results in an exposure (i.e., the non-overlapped or exposed portion of the front face of an installed tile) of from about 329 to about 426 square centimeters in the case of a 30.5 cm×15.2 cm tile, and an exposure of from about 406 to about 503 square centimeters for a 35.6 cm×15.2 cm tile, which are fairly large exposures as compared to, for example, traditionally laid slate. More specifically, contemplated exposures range from about 71 to about 93%, preferably from about 75 to about 89%, more preferably, from about 79 to about 86%, of the total area of the front face of the tile. Exposures for traditionally laid slate, for example, range from about 37.5% to about 41.6% of the total area of the front face of each tile.

In one exemplary embodiment, the current invention includes the following steps of use. The front and back faces of roofing slate tiles are thoroughly cleaned via water, brush, and detergent or solvent as necessary to allow gluing of the hook and loop fastener tape. The roof deck is thoroughly cleaned with water, brush, and detergent or solvent as necessary to allow proper adhesion of the glued sheet material or sheet material/insulation board assembly. A primer may be applied if required by the adhesive system.

Two pieces of hook and loop fastener tape are applied horizontally across the top and bottom of the back face of the individual slate tiles. One piece of hook and loop tape is applied horizontally across the top of the front face of the individual slate tile. Patterned slate, for example with diamond or rounded butts or lower edges; may require different orientation and coverage of hook and loop fastener material. Hip, ridge, valley, and starter slate requires different hook and loop fastener layouts. A rain diverting device may be applied to each tile either before shipment or just prior to installation. As noted above, the rain diverting device is applied so that approximately one-half of the width of the device extends beyond the edge (the right side-edge portion) of each tile.

For shipment; slates with tapes attached are stacked vertically on pallets with hook facing hook, and loop facing loop. For wind and snow prone areas, or for certain components of a roof such as the hip and ridge, both sides of the hook and loop fastener system may be treated with a two part or thermoset adhesive.

For thicker tiles with a larger airspace between the tiles and the roof deck (i.e., tiles having a thickness exceeding 9.5 mm), a Z-shaped spring may be used. The Z-shaped spring may be made from a metal or metal-like material. Due to its spring-like nature, it can be pressed or pulled but returns to its former shape once the applied force is released. The bottom face of the Z-shaped spring is adhered (e.g., via adhesive or hook and loop fastener) to the back face of the tile. A hook and loop fastener tape is adhered to the exposed top face of the Z-shaped spring. The expanding spring quality of the Z-shaped spring serves a dual purpose of supporting an overlying tile while pressing together the hook and loop fasteners of the top face of the Z-shaped spring and the upper face of the sheet material.

The Z-shaped spring may run horizontally across the width or vertically along the length of the back face of each tile. In one contemplated embodiment, the Z-shaped spring is positioned horizontally along the back face of each tile between the rain diverter devices. In another contemplated embodiment, the Z-shaped spring is positioned vertically along the length of the back face of each tile, either stopping short of, or overlapping hook and loop fastener strips located on the back face at or near the uppermost and lowermost edges of each tile.

In this exemplary embodiment, individual pieces of slate are positioned next to a previously applied tile and pressed onto the exposed rain diverting device of the previously applied tile and onto the hook and loop fastener on an upper surface of the underlying sheet material, which has been previously applied to the roof. The rain diverting device releasably adheres the adjacent tiles to one another and assists in adhering them to the underlying sheet material. The slate tiles are overlapped by about 5.1 centimeters at the top and bottom. Thus, the hook and loop fastener tape applied to the bottom of the back face of a piece of slate connects with the hook and loop fastener tape applied across the top of the front face of another slate. In wind prone areas, it may be desirable to pre-treat the sheet material and the hook and loop tapes with a slow setting epoxy or contact cement. Until the adhesive is tacky or set up, the detachable, re-attachable nature of the hook and loop system remains available for changes during installation.

A traditionally laid slate roof is typically triple overlapped with a 7.6 cm headlap. Thus a 30.5 cm long piece of traditionally laid slate would have 11.4 cm exposure, 11.4 cm of triple lapped covered or unexposed slate, and 7.6 cm of headlap. With this system, only a single 5.1 cm overlap is needed due to the presence of the rain diverting device and the sheet material. This results in greater exposure, namely, 71 to 93% exposure for a 30.5 cm long piece of slate. This also results in about 45% of weight reduction versus traditionally applied slate. Further, there are additional savings in time, money, and weight due to the absence of nails. Carefully driving these nails far enough down so they are not under nailed (head of nail sticking up from face of slate) or over nailed (nail head driven down into countersink on face of slate) risks breaking the slate during installation. Typically, an accomplished traditional slate roofer can only apply 3-4 square in a day, due to the time and care involved in nailing. The current roofing system, with individual pieces of slate (each with an applied rain diverting device) just pressed together with the hook and loop system doing the attachment, is estimated to be applied 4 to 5 times faster than traditional nailed slate.

The hook and loop system takes out much of the variable quality and expensive field labor of a traditional installation method. Individual tiles may be easily pressed together in patterns which may be dictated by field conditions. Changing an individual tile because of improper color or placement is easily solved by the detachable and replaceable nature of the hook and loop fastening system.

Referring to FIGS. 1-7, the present invention includes a system and method of roofing. The present invention includes a sheet material 30 having an upper surface and a lower surface. The upper surface includes one of a hook and loop fastener 28 and the lower surface is configured to be attached to a roof deck 34. The present invention further includes a plurality of tiles 10 each having an upper edge, a lower edge; a top surface 12, and a back face 14. Hook and loop fastener 16 is applied to top surface 12 of each tile 10.

The other of the hook and loop fastener 18, 20 is attached to the back face 14 of each of the tiles 10.

The one of the hook and loop fastener 16, 28 may be either the hook or the loop portion of the hook and loop fastener. The other of the hook and loop fastener 18, 20 is complimentary and releasably connects to hook and loop fastener 16, 28. For example, the one of the hook and loop fastener 16, 28 is a loop fastener and the other of the hook and loop fastener 18, 20 is a hook fastener or vis versa.

The sheet material 30 includes an upper surface and the lower surface. An adhesive layer 32 may be disposed on the lower surface of the sheet material 30 and one of the hook and loop fasteners 28 is disposed on its upper surface. In such embodiments, the adhesive layer 32 secures the sheet material 30 to the roof deck 34. In one embodiment, the sheet material 30 may include printed or etched lines in a grid pattern to provide a reference for orientation of the individual slate tiles 10 pressed down upon it.

Each of the plurality of tiles 10 may further include a first strip 18 including the hook and loop fastener attached to the back face 14 at the upper edge, a second strip 20 including the hook and loop fastener attached to the back face 14 at the lower edge; and a third strip 16 having the hook and loop fastener attached to the top surface 12 at the upper edge. In such embodiments, the tiles 10 are releasably secured to the upper surface of the sheet material 30 by: installing a first row or starter course of tiles on the sheet material positioned on the roof deck; releasably securing the first strips 18 of the tiles 10 in subsequent rows to the upper surface of the sheet material 30; overlapping the tiles 10 with one another; and releasably securing the second strips 20 of the tiles to the third strips 16 of overlying tiles.

Each of the plurality of tiles 10 may further include a support 22 disposed in between the upper edge and the lower edge and extending from the back face 14 of the tiles 10. The support 22 includes a Z-shaped spring having an upper arm adhered to the back face of the tile 10, and a lower arm. The lower arm includes a fourth strip 24 of hook and loop fastener that releasably connects with the hook and loop fastener 28 of the sheet material 30.

Figure 8:
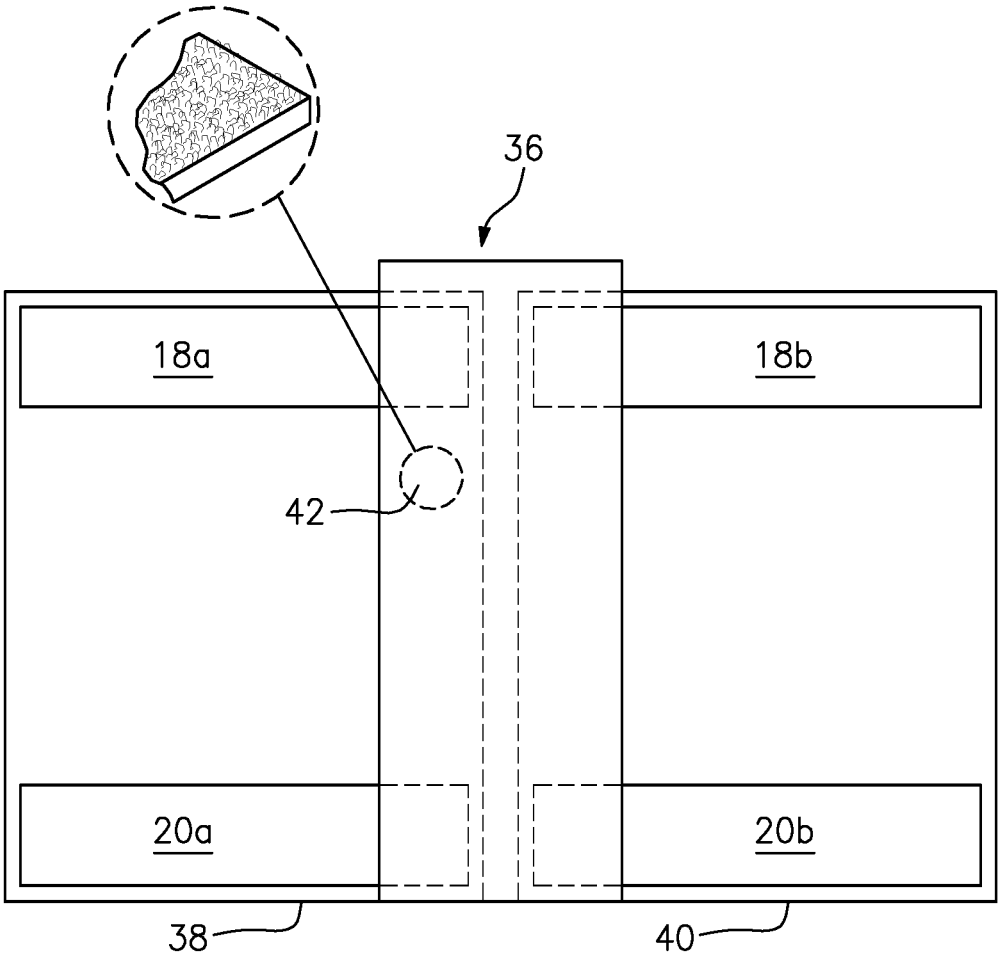
FIG. 8 is a bottom perspective view of an exemplary embodiment of the present invention in which two tiles are interlocked by a rain diverting device, an expanded view of a portion of one surface of the rain diverting device also shown in this view.

An exemplary embodiment of the rain diverting device of the present invention is shown in FIG. 8 and marked with reference number 36. The rain diverting device 36 is positioned over the hook and loop fasteners located on side-edge portions of adjacent tiles 38, 40 interlocking with portions of first strips 18*a,b* and second strips 20*a,b* on the adjacent tiles. The surface 42 of device 36, which is shown in the expanded portion of FIG. 8 as "loop" fasteners, interlocks with the sheet material (not shown). While the rain diverting device 36 is shown extending beyond the upper edges of the adjacent tiles, this is not necessary, and the device instead may be sized to match the length of the adjoining tiles. As previously stated, the use of rain diverting devices to direct rainwater and snowmelt away from an underlying sheet material and roof deck allows for single lap tiling and thus less weight on the roof deck. It also allows for shorter tiles to be used, thus saving material cost.

Figure 9:
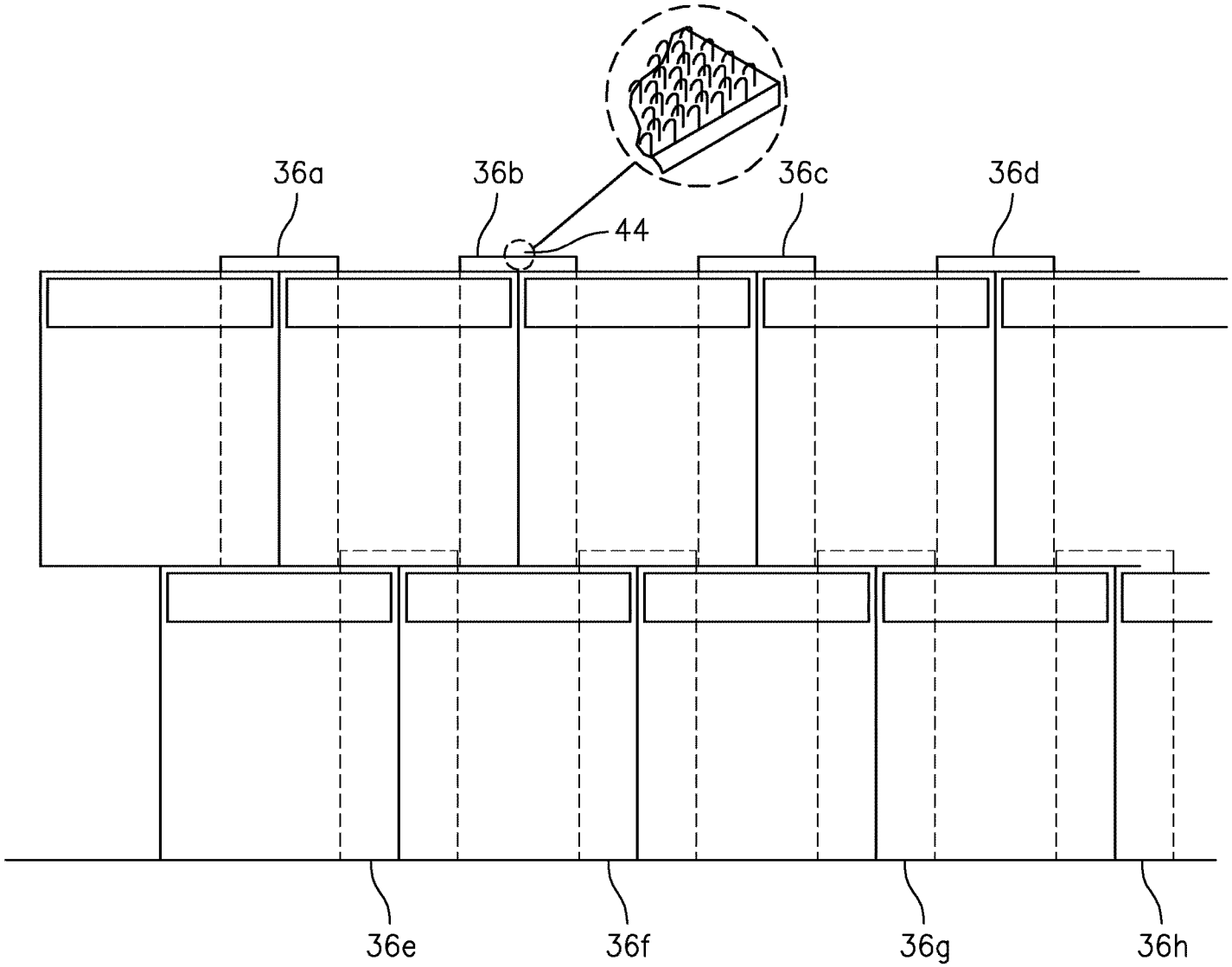
FIG. 9 is a top perspective view of an exemplary embodiment in which two rows of tiles, including those tiles shown in FIG. 8, are shown interlocked with adjoining tiles by the rain diverting devices, an expanded view of a portion of an opposing side of the rain diverting device also shown in this view.

FIG. 9 depicts two rows or courses of tiles on a roof deck, with adjacent tiles interconnected with rain diverting devices 36*a-h*. The rain diverting devices 36*a-h* serve to direct rainwater and snowmelt away from the underlying sheet material (not shown). The surface 44 of device 36*b* is shown in the expanded portion of FIG. 9 as "hook" fasteners.

Figure 10:
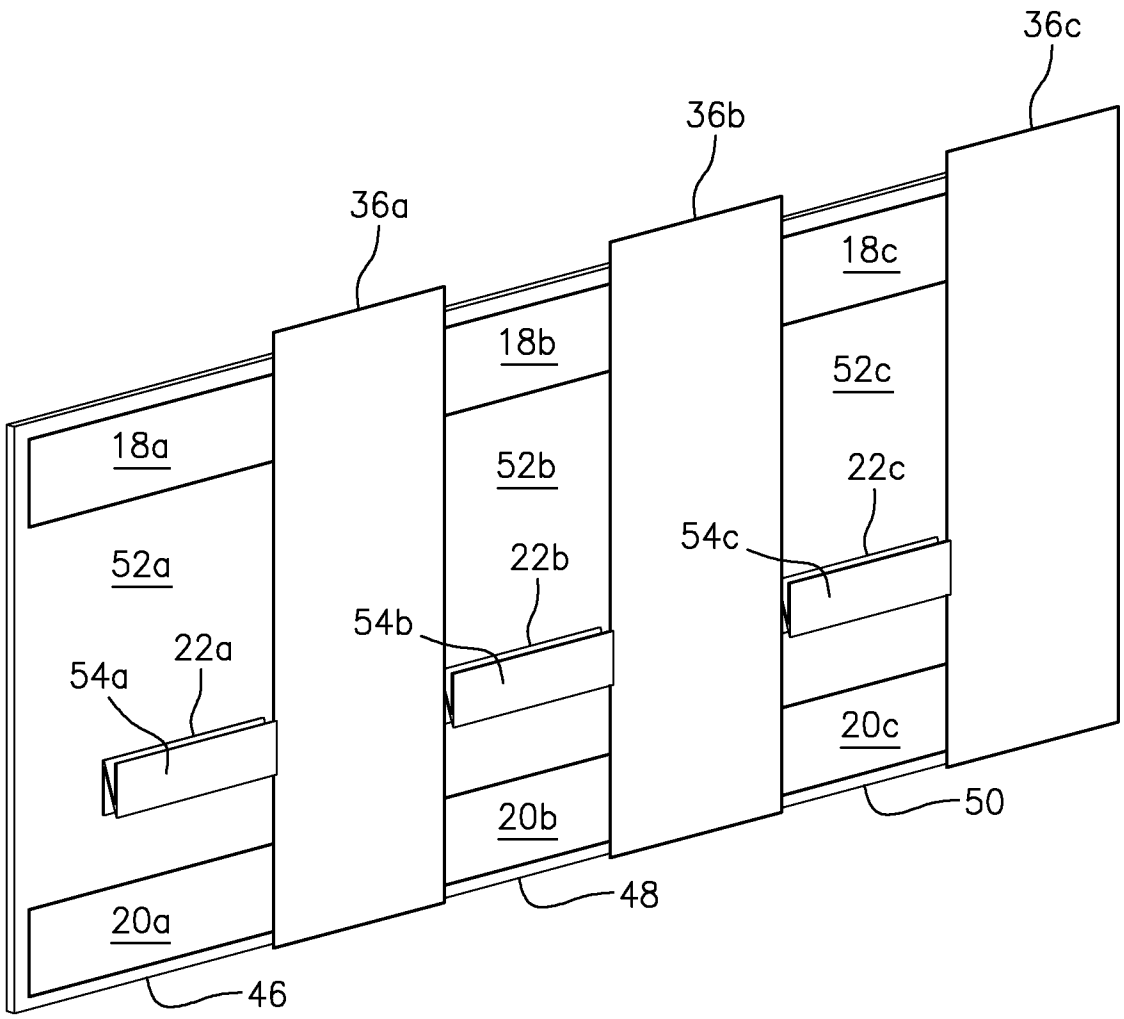
FIG. 10 is a bottom perspective view of three (3) tiles, each interconnected to adjacent tiles with the rain diverting device of the present invention and each employing a Z-shaped spring positioned horizontally across the exposed back face of each tile.

FIG. 10 depicts three adjacent tiles 46, 48, 50, which are interconnected by way of rain diverting devices 36*a-c*. Each of these tiles have the added feature of a support or Z-shaped spring 22*a-c*, positioned horizontally across the exposed back face 52*a-c* of each tile. A hook and loop fastener tape 54*a-c* is adhered to the exposed top face of the Z-shaped spring. As noted above, the Z-shaped spring serves to support each tile and to press the hook and loop fastener tape 54*a-c* on its exposed top face to the hook and loop fastener of the underlying sheet material (not shown).

Figure 11:
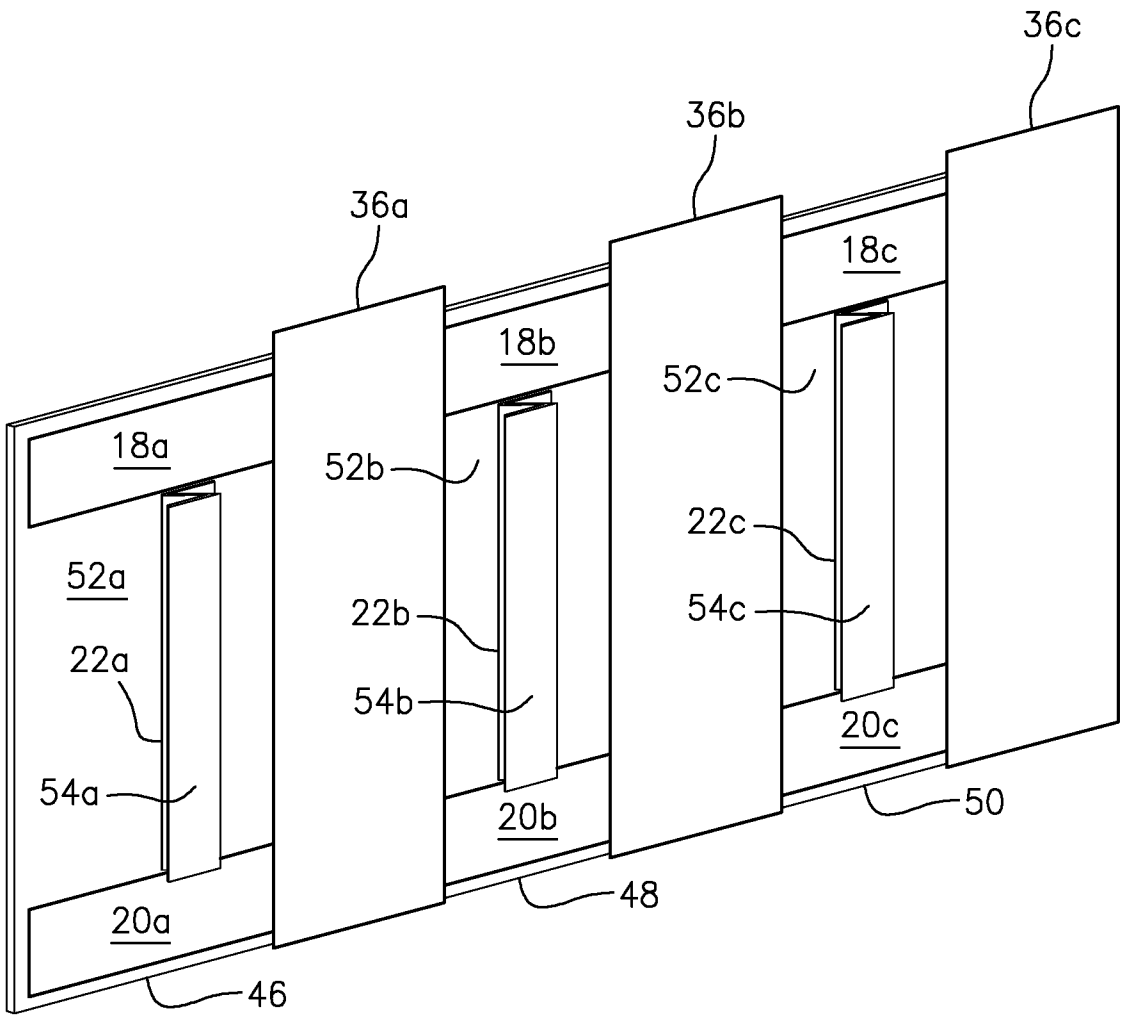
FIG. 11 is a bottom perspective view of three (3) tiles, each interconnected to adjacent tiles with the inventive rain diverting device and each employing a Z-shaped spring extending vertically along a midline on the back face of each tile just short of the first and second strips.

As noted above, and as shown in FIG. 11, the Z-shaped springs 22*a-c* may also extend vertically along a midline on the back face 52*a-c* of each tile, just short of the first strips 18*a,b,c* and the second strips 20*a,b,c*. In this embodiment, the Z-shaped spring may be adhered to the exposed back face 52*a-c* of each tile using, for example, an adhesive.

Figure 12:
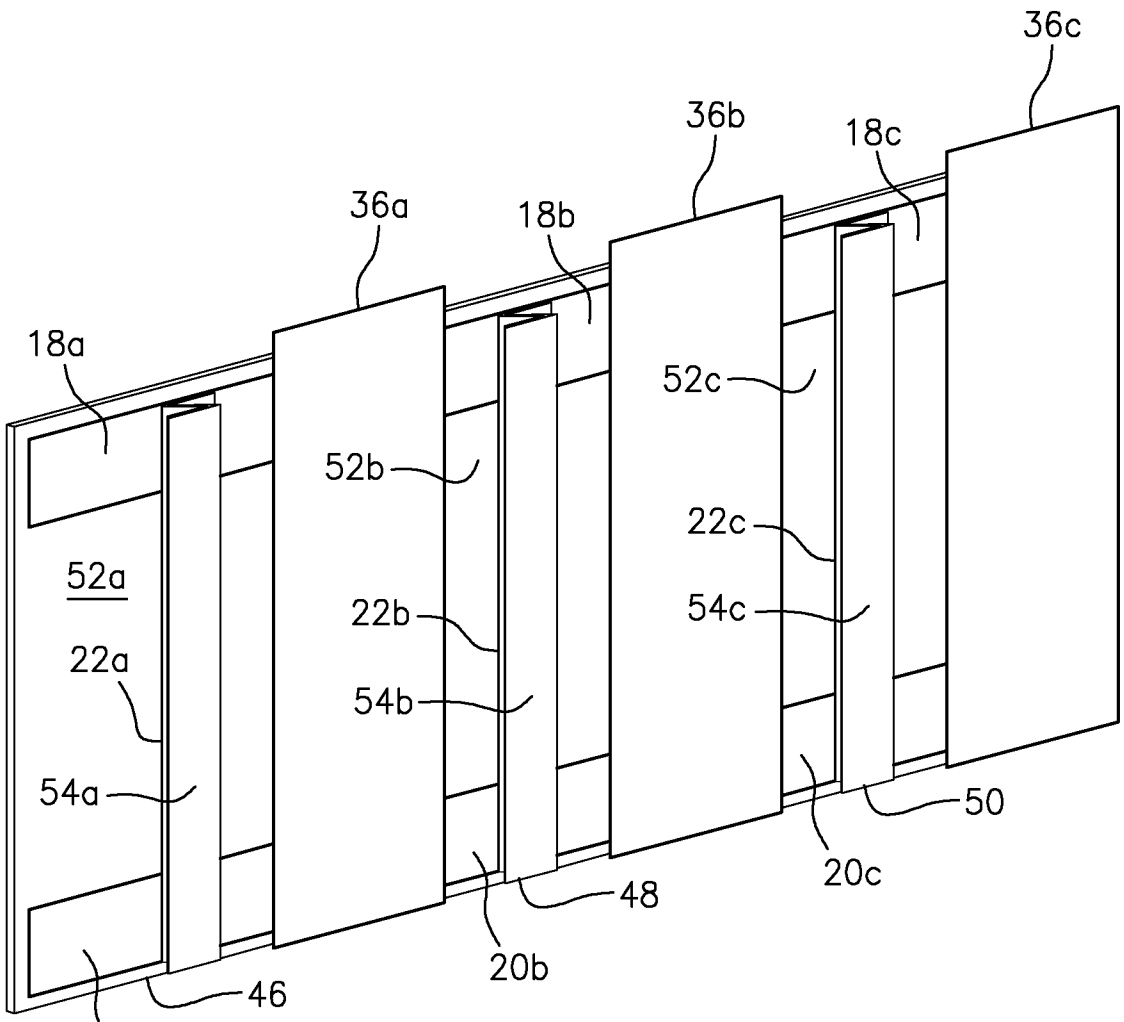
FIG. 12 is a bottom perspective view of three (3) tiles, each interconnected to adjacent tiles with the inventive rain diverting device and each employing a Z-shaped spring extending vertically along a midline on the back face of each tile and extending over (and releasably attached to) the first and second strips.

In FIG. 12, the Z-shaped springs 22*a-c* are shown extending vertically along a midline on the back face 52*a-c* of each tile and over the first strip 18*a,b,c* and the second strip 20*a,b,c* of each tile. In this embodiment, a hook and loop fastener tape is adhered to both the top and bottom faces of each Z-shaped spring, the bottom face of each Z-shaped spring being releasably engaged with the first and second strips.

It should be understood, of course, that the foregoing relates to exemplary embodiments of the invention and that modifications may be made without departing from the spirit and scope of the invention as set forth in the following claims.

What is claimed is:

1. A system of pitched roofing, which comprises:

a sheet material for adhering to a roof deck, which has an upper surface and a lower surface, the upper surface including a hook and loop fastener;

a plurality of roofing tiles each having a front face and a back face and a length extending from an upper edge to a lower edge, wherein the back face of each tile has opposing side-edge portions;

hook and loop fasteners adhered to and covering a portion of the back face of each tile including a portion of the opposing side-edge portions;

a plurality of rain diverting devices, each device having one surface made up of a plurality of hook portions and an opposing surface made up of a plurality of portions complementary to the hook portions, wherein each rain diverting device is positioned between, extending along at least the entire length of two adjacent tiles, and releasably attached to the hook and loop fasteners located on a side-edge portion of the adjacent tiles and the sheet material, thereby releasably attaching the tiles to each other and to the upper surface of the underlying sheet material, wherein each rain diverting device serves to direct rain and snowmelt away from a separation between adjacent tiles and the underlying sheet material and down onto tiles one or more rows below the separation between adjacent tiles.

2. The system of roofing of claim 1, wherein the rain diverting device has one surface made up of a plurality of hook portions, and an opposing surface made up of a plurality of loop portions.

3. The system of roofing of claim 1, wherein the rain diverting device is a strip-like device that has a thickness of less than or equal to about 3 millimeters, a width ranging from about 5.1 to about 15.2 centimeters, and a length ranging from about 100% to about 120% of the average length of the adjacent tiles.

4. The system of roofing of claim 1, wherein the roofing tiles are selected from the group of slabs or shingles made from asphalt, wood, cement, fiber-cement mixtures, concrete, clay or ceramic material, slate or slate substitute, rubber slate, and other hardwearing materials and metal.

5. The system of roofing of claim 4, wherein the roofing tiles are selected from the group of slate, slate substitute and rubber slate tiles.

6. The system of roofing of claim 1, wherein the upper surface of the sheet material contains a grid pattern for providing a reference for placement of the tiles pressed down upon it.

7. The system of roofing of claim 1, wherein the lower surface of the sheet material is adhered to an insulation board, which is adhered to the roof deck.

8. The system of roofing of claim 1, wherein the hook and loop fasteners are in the form of strips having a width greater than about 2.54 centimeters.

9. The system of roofing of claim 8, wherein the hook and loop fastener strips have a width ranging from about 3.8 to about 6.4 centimeters.

10. The system of roofing of claim 1, wherein the hook and loop fasteners have a combined thickness of less than or equal to about 3 millimeters.

11. The system of roofing of claim 1, wherein the hook and loop fasteners extend along the width of the tile on the back face at or near uppermost and lowermost edges of the tile.

12. The system of roofing of claim 11, wherein hook and loop fasteners also extend along the width of the tile at or near the uppermost edge of the front face.

13. The system of roofing of claim 12, wherein the hook and loop fasteners on the upper surface of the sheet material and adhered to the front face of each tile are hook fasteners and the hook and loop fasteners adhered to the back face of each tile are loop fasteners.

14. The system of roofing of claim 13, wherein the surface of the rain diverting device made up of a plurality of hook portions is positioned over the back face of each tile, and the surface of the rain diverting device made up of a plurality of portions complementary to the hook portions is positioned over the upper surface of the sheet material.

15. The system of roofing of claim 1, wherein the roofing tiles are single lapped with exposed portions of the front face of each tile ranging from about 71 to about 93% of the total area of the front face.

16. The system of pitched roofing of claim 1, which further comprises a support disposed in between the upper edge and the lower edge and extending from the back face.

17. The system of claim 16, wherein the support comprises a Z-shaped spring having an upper arm adhered to the back face of the tile, and a lower arm.

18. The system of claim 17, wherein the lower arm of the Z-shaped spring has a surface made up of a hook and loop fastener complimentary to the hook and loop fastener of the sheet material.

19. A method of installing shingles or tiles on a roof, which comprises:

providing a sheet material having an upper surface and a lower surface, the upper surface including a hook and loop fastener;

securing the lower surface of the sheet material to a roof deck;

providing a plurality of roofing tiles, each tile having a length extending from an upper edge to a lower edge and a back face with opposing side-edge portions, wherein hook and loop fasteners are adhered to and cover a portion of the back face of each tile including a portion of the opposing side-edge portions;

providing a plurality of rain diverting devices, each device having one surface made up of a plurality of hook portions and an opposing surface made up of a plurality of portions complementary to the hook portions, positioning each rain diverting device between, extending along at least the entire length of two adjacent tiles, and releasably attaching each device to the hook and loop fasteners located on a side-edge portion of the adjacent tiles and the underlying sheet material, thereby releasably attaching the tiles to each other and to the upper surface of the sheet material, wherein each rain diverting device serves to direct rain and snowmelt away from a separation between adjacent tiles and the underlying sheet material and down onto tiles one or more rows below the separation between adjacent tiles.

20. A method of using a device having one surface made up of a plurality of hook portions and an opposing surface made up of a plurality of portions complementary to the hook portions to direct rainwater and snowmelt away from an underlying sheet material on a roof deck, which comprises: positioning the device between, extending along at least an entire length of two adjacent tiles, and releasably attaching the device to hook and loop fasteners located on a side-edge portion of the adjacent roofing tiles and an underlying sheet material, thereby releasably attaching the tiles to each other and to the upper surface of the underlying sheet material, wherein each rain diverting device serves to direct rain and snowmelt away from a separation between adjacent tiles and the underlying sheet material and down onto tiles one or more rows below the separation between adjacent tiles.

21. A system of pitched roofing, which comprises:

a sheet material for adhering to a roof deck, which has an upper surface and a lower surface, the upper surface including a hook and loop fastener;

a plurality of roofing tiles each having a front face and a back face and a length extending at least from an upper edge to a lower edge, wherein the back face of each tile has opposing side-edge portions;

hook and loop fasteners adhered to and covering a portion of the back face of each tile including a portion of the opposing side-edge portions;

a plurality of rain diverting devices, each device having one surface made up of a plurality of hook portions and an opposing surface made up of a plurality of portions complementary to the hook portions, wherein each rain diverting device is positioned between, extending along at least the entire length of two adjacent tiles, and releasably attached to the hook and loop fasteners located on a side-edge portion of the adjacent tiles and the sheet material, thereby releasably attaching the tiles to each other and to the upper surface of the underlying sheet material, wherein each rain diverting device serves to direct rain and snowmelt away from a separation between adjacent tiles and the underlying sheet material and down onto tiles one or more rows below the separation between adjacent tiles, wherein the roofing tiles are selected from the group of slate, slate substitute and rubber slate tiles.

22. A method of installing shingles or tiles on a roof, which comprises:

providing a sheet material having an upper surface and a lower surface, the upper surface including a hook and loop fastener;

securing the lower surface of the sheet material to a roof deck;

providing a plurality of roofing tiles, each tile having a length extending from at least an upper edge to a lower edge and a back face with opposing side-edge portions, wherein hook and loop fasteners are adhered to and cover a portion of the back face of each tile including a portion of the opposing side-edge portions;

providing a plurality of rain diverting devices, each device having one surface made up of a plurality of hook portions and an opposing surface made up of a plurality of portions complementary to the hook portions, positioning each rain diverting device between, extending along at least the entire length of two adjacent tiles, and releasably attaching each device to the hook and loop fasteners located on a side-edge portion of the adjacent tiles and the underlying sheet material, thereby releasably attaching the tiles to each other and to the upper surface of the sheet material, wherein each rain diverting device serves to direct rain and snowmelt away from a separation between adjacent tiles and the underlying sheet material and down onto tiles one or more rows below the separation between adjacent tiles, wherein the roofing tiles are selected from the group of slate, slate substitute and rubber slate tiles.

23. A method of using a device having one surface made up of a plurality of hook portions and an opposing surface made up of a plurality of portions complementary to the hook portions to direct rainwater and snowmelt away from an underlying sheet material on a roof deck, which comprises: positioning the device between, extending along at least an entire length of two adjacent tiles, and releasably attaching the device to hook and loop fasteners located on a side-edge portion of the adjacent roofing tiles and an underlying sheet material, thereby releasably attaching the tiles to each other and to the upper surface of the underlying sheet material, wherein each rain diverting device serves to direct rain and snowmelt away from a separation between adjacent tiles and the underlying sheet material and down onto tiles one or more rows below the separation between adjacent tiles, wherein the roofing tiles are selected from the group of slate, slate substitute and rubber slate tiles.

24. A system of pitched roofing, which comprises:

a sheet material for adhering to a roof deck, which has an upper surface and a lower surface, the upper surface including a hook and loop fastener;

a plurality of roofing tiles each having a front face and a back face and a length extending from an upper edge to a lower edge, wherein the back face of each tile has opposing side-edge portions;

hook and loop fasteners adhered to and covering a portion of the back face of each tile including a portion of the opposing side-edge portions;

a plurality of rain diverting devices, each device having one surface made up of a plurality of hook portions and an opposing surface made up of a plurality of portions complementary to the hook portions, wherein each rain diverting device is positioned between, extending along at least the entire length of two adjacent tiles, and releasably attached to the hook and loop fasteners located on a side-edge portion of the adjacent tiles and the sheet material, thereby releasably attaching the tiles to each other and to the upper surface of the underlying sheet material, wherein each rain diverting device serves to direct rain and snowmelt away from a separation between adjacent tiles and the underlying sheet material and down onto tiles one or more rows below the separation between adjacent tiles, wherein the roofing tiles are selected from the group of slate, slate substitute and rubber slate tiles, and wherein the roofing tiles are single lapped with exposed portions of the front face of each tile ranging from about 71 to about 93% of the total area of the front face.

* * * * *